US005469021A

United States Patent [19]

Lepselter

[11] Patent Number: 5,469,021

[45] Date of Patent: Nov. 21, 1995

[54] GAS DISCHARGE FLAT-PANEL DISPLAY AND METHOD FOR MAKING THE SAME

[75] Inventor: Martin P. Lepselter, Summit, N.J.

[73] Assignees: BTL Fellows Company, LLC; Spectron Corporation of America, L.L.C., both of Summit, N.J.

[21] Appl. No.: 70,511

[22] Filed: Jun. 2, 1993

[51] Int. Cl.[6] ..... H01J 17/20

[52] U.S. Cl. ..... 313/582; 313/572; 313/637

[58] Field of Search ..... 313/582, 484, 313/521, 572, 574, 568, 637; 345/41, 60, 63; 315/169.4

[56] References Cited

U.S. PATENT DOCUMENTS

| | | | |
|---|---|---|---|
| 3,461,524 | 8/1969 | Lepselter . | |
| 3,612,938 | 10/1971 | De Boer et al. . | |
| 3,622,829 | 11/1971 | Watanabe . | |
| 3,631,286 | 12/1971 | Anderson et al. . | |
| 3,634,714 | 1/1972 | Anderson et al. . | |
| 3,646,384 | 2/1972 | Lay . | |
| 3,704,052 | 11/1972 | Coleman . | |
| 3,845,241 | 10/1974 | Schwartz . | |
| 3,892,998 | 7/1975 | Tsui et al. . | |
| 3,956,667 | 5/1976 | Veith . | |
| 3,973,164 | 8/1976 | Nolan et al. . | |
| 3,989,974 | 11/1976 | Tottori et al. . | |
| 4,048,533 | 9/1977 | Hinson et al. . | |
| 4,056,806 | 11/1977 | Schmersal et al. . | |
| 4,130,778 | 12/1978 | Branston . | |
| 4,160,191 | 7/1979 | Hausfeld . | |
| 4,341,976 | 7/1982 | Hanlet . | |
| 4,633,139 | 12/1986 | Endo et al. | 315/169.4 |
| 4,638,218 | 1/1987 | Shinoda et al. . | |
| 4,737,687 | 4/1988 | Shinoda et al. . | |
| 4,908,539 | 3/1990 | Meyer . | |
| 4,920,409 | 4/1990 | Yamagishi . | |
| 4,963,114 | 10/1990 | Andreadakis . | |
| 5,276,384 | 1/1994 | Martin | 315/169.4 |
| 5,315,213 | 5/1994 | Kim | 315/169.4 |

FOREIGN PATENT DOCUMENTS

| | | |
|---|---|---|
| 0525763 | 2/1993 | European Pat. Off. . |
| 2337418 | 7/1977 | France . |
| 4023081 | 1/1992 | Germany . |

OTHER PUBLICATIONS

S. C. Miller, Neon Techniques and Handling, p. 11 (3d Ed. 1977).

Depp and Howard, Flat–Panel Displays, Scientific American (Mar. 1993) p. 90.

Lawrence E. Tannas, Jr. *Flat–Panel Displays and CRTs* (Van Nostrand Reinhold Co., New York—1985).

Dr. Y. Raizer *Gas Discharge Physics* (Springer Verlag 1991, pp. 133–137, 56–57, Figs. 6–9).

A Plasma Bubble Display: A New Approach to the Design of a Shift–Addressed AC Plasma Display—By: David G. Boyers, Member, IEEE.

Boyer's Ph.D. Dissertation (Portions thereof including cover, table of contents, abstract, nomenclature, list of figures and tables, pp. 1–8, 30, 32, 122–130, 137–140, 164, 170, 185–187, Chapter 6 (pp. 202–245), 260, 272–276.

"Characteristics and Device Applications of Plasma Buble Domains" by Boyers and David Graham, 1982, Dissertation Abstract (p. 565 of vol. 44/02–R).

"Plasma Discharge Display with Constant Anode and Cathode Spacing" by Gerard G, 1981, FR 798393 Abstract.

*Primary Examiner*—Sandra L. O'Shea
*Assistant Examiner*—Vip Patel
*Attorney, Agent, or Firm*—Darby & Darby

[57] ABSTRACT

A flat-panel gas discharge display operable with either alternating or direct current is free of implosive forces because it operates at substantially atmospheric pressure. The display comprises a first set of conductors disposed on a transparant substrate and a second set of conductors crossing over the first set at a distance therefrom. An array of crosspoints is formed at each location where a conductor of the second set crosses over a conductor of the first set. A gas is contained in the space between the sets of conductors at each crosspoint. The gas will undergo light emissive discharge when a Paschen minimum firing voltage is applied to the pair of crossed conductors crossing at that crosspoint. Air may be used as the operative gas. The display may be formed on a single side of the substrate. At least one of the sets of conductors may be provided with an aperture at each of the crosspoints to facilitate viewing the discharge. A system incorporating the flat-panel display is described.

8 Claims, 4 Drawing Sheets

GAS DISCHARGE FLAT-PANEL DISPLAY AND METHOD FOR MAKING THE SAME

BACKGROUND OF THE INVENTION

This invention relates to a flat-panel display structure and a method for making the same and, in particular, to a gas discharge display foraged on a single side of a substrate operable with gases at substantially atmospheric pressure.

Plasma based flat-panel displays have been known since the late 1960's. Broadly, such displays enclose a gas or mixture of gases in a partial vacuum sealed between opposed and crossed ribbons of conductors. The crossed conductors define a matrix of crossover points which are essentially an array of miniature neon picture elements ("pixels") or lamps that provide their own light. At any given pixel, the crossed, spaced conductors act like opposed electrode plates of a capacitor. At each intersection point, a sufficiently large applied voltage causes the gas to break down locally into a plasma of electrons and ions and glow as it is excited by current. Paschen's Law relates the voltage at which a gas breaks down into a plasma, the so called spark or firing voltage, to the product of the pressure of the gas, p (in mm Hg), times the distance, d (in cm), between the electrodes. By scanning the conductors sequentially, a row at a time, with a voltage sufficient to cause the pixels to glow, and repeating the process at least sixty times per second, a steady image can be perceived by the human eye.

These displays have heretofore required that a partial vacuum be established in order to bring the pressure-distance product closer to the region of the so called Paschen minimum firing voltage. The low pressure ambient employed in prior art designs ensured a longer mean free path for liberated electrons by lowering the density of gas molecules in the region between the conductors. The low pressure ambient facilitated higher current levels because the liberated electrons could travel .faster toward other gas molecules and hit them harder to free additional electrons. See S. C. Miller, Neon Techniques and Handling, p. 11 (3d Ed. 1977).

The need to establish a partial vacuum has created manufacturing complexities which have increased the cost of producing flat-panel gas discharge displays. The pressure imbalance between the internal vacuum environment and the external atmosphere has necessitated manufacturing flat-panel displays from reinforced materials so as to withstand the implosive pressure (fifteen pounds per square inch) exerted across the display surface of the panels. Also, rare gases are used for the plasma material which require sophisticated manufacturing facilities. These problems have inspired much of the more recent efforts in the field to look to display structures of other designs including liquid crystals and electroluminescent polymers. See Depp and Howard, Flat-Panel Displays, Scientific American (March 1993) p. 90. Accordingly, it would be advantageous to manufacture a gas discharge flat-panel display operable at atmospheric pressure using air as the operative gas.

SUMMARY OF THE INVENTION

An object of this invention is to provide a flat-panel display operable at substantially atmospheric pressure.

An additional object is to provide a flat-panel display that induces light emissive discharge in a gas at or near the gas's Paschen minimum firing voltage.

Another object is to provide a gas discharge flat-panel display not subject to implosive forces.

The present invention provides a flat-panel gas discharge display operable with either alternating or direct current that is free of implosive forces because it operates at substantially atmospheric pressure. The display comprises a first set of conductors disposed on a transparant substrate and a second set of conductors which cross over the first set at a distance therefrom. An array of crosspoints is formed at each location where a conductor of the second set crosses over a conductor of the first set. A gas is contained in the space between the sets of conductors at each crosspoint which will undergo light emissive discharge when a Paschen minimum firing voltage is applied across the space at that crosspoint. An important feature of the present invention is that air may be used as the operative gas which minimizes the cost and complexity of manufacture. Longevity of the panel is preserved by selecting the cathode material from among known non-sputterable conductors. In a preferred embodiment, the display is formed on a single side of a substrate. Also in a preferred embodiment, at least one of the sets of conductors may be provided with an aperture at each of the crosspoints to facilitate viewing the discharge.

These and other objects, features and advantages of the present invention will be readily apparent from the following detailed description of certain preferred embodiments taken in conjunction with the accompanying unscaled drawings, in which.

DETAILED DESCRIPTION OF THE PREFERRED EMBODIMENTS

Figure 1:
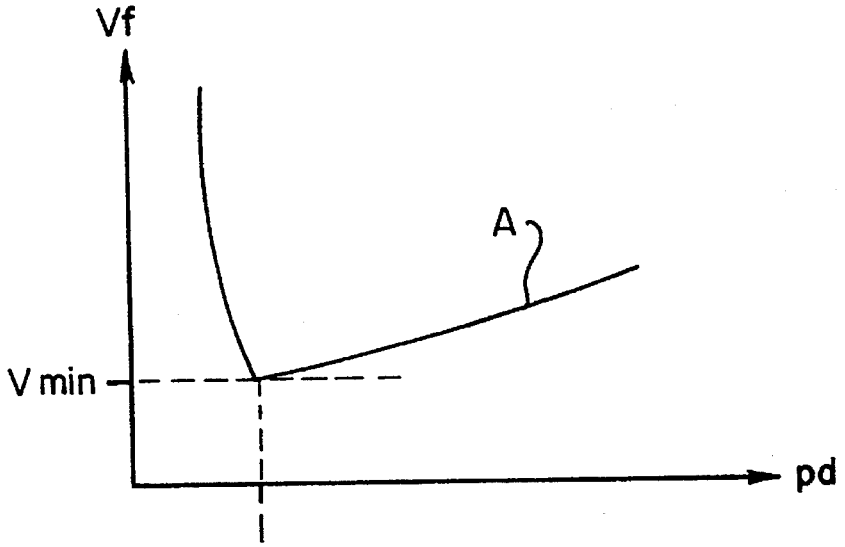
FIG. 1 is a diagram for explaining Paschen's law.

In accordance with Paschen's Law, every gas has a characteristic minimum firing voltage $V_{min}$ (see FIG. 1) associated with a pressure-distance ("pd") product of approximately unity for a wide range of gases and electrodes. The firing voltage rises above this minimum at all other values of the pd product. In the region below curve A, a gas will not spark and there will be no initial discharge; however, an existing discharge can be sustained with voltages in this region. It is generally desirable to design a gas discharge displays to operate at or near the Paschen minimum firing voltage in order to facilitate interconnection with microelectronic control circuitry.

Figure 2:
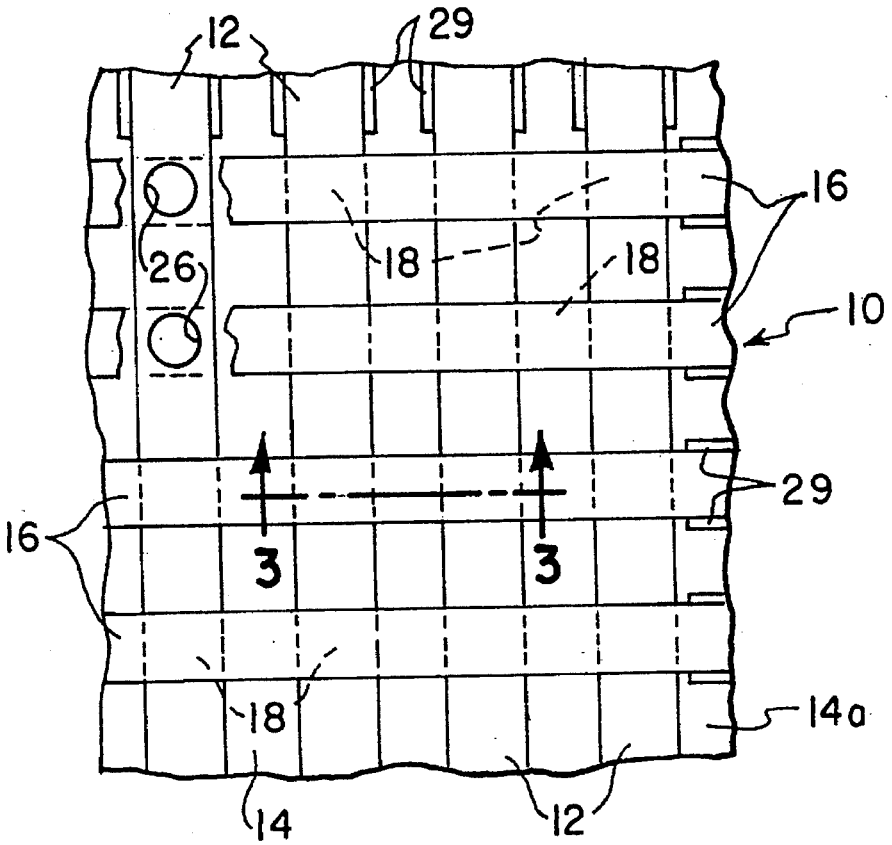
FIG. 2 is a top elevational view of a portion of a flat-panel display constructed in accordance with the present invention.
Figure 3:
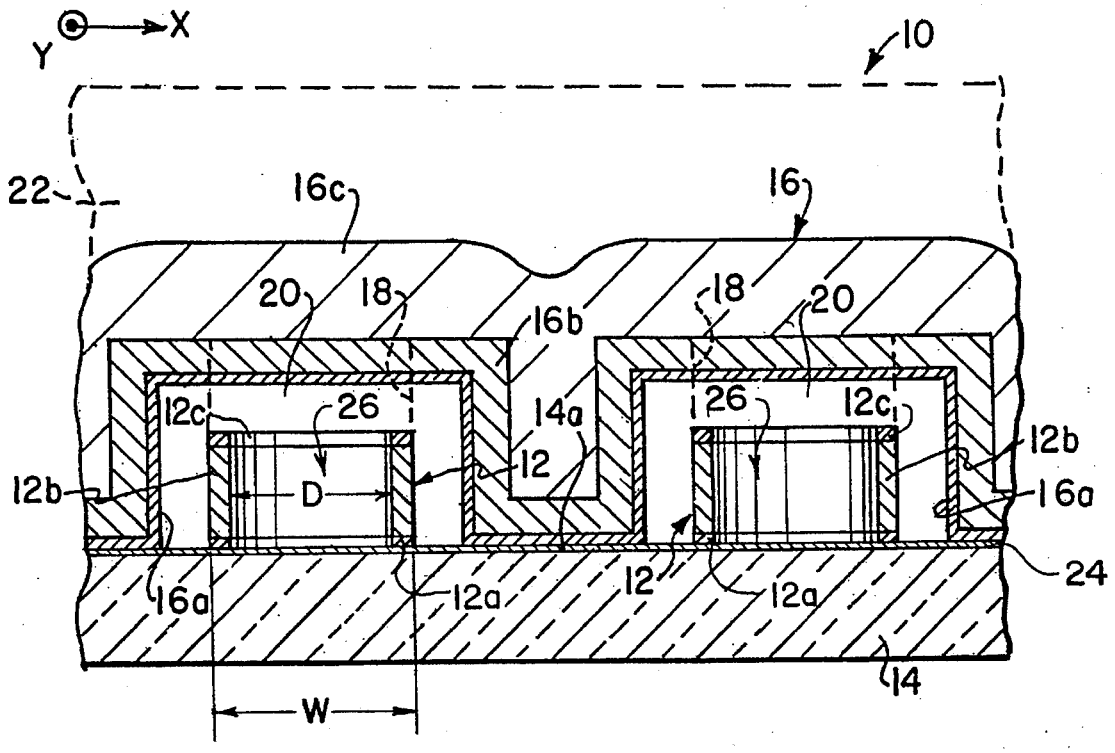
FIG. 3 is a cross-sectional view along line 3—3 of FIG. 2.

By way of overview and introduction, there is seen in FIGS. 2 and 3 a portion of a flat-panel display 10 formed in accordance with a preferred embodiment of the present invention. The fabricated structure 10 comprises a set of conductors 12 disposed in y-directed columns on an insulating substrate 14 and a second set of conductors 16 disposed in x-directed rows which cross over the first set to form a regular array of crosspoints 18. A gas contained in at least a space 20 defined by each of these crosspoints 18 is broken down into a plasma upon application of a suitable voltage in accordance with Paschen's law, described above.

For ease of illustration and as a preferred configuration, conductors 12 and 16 are shown as linear ribbons of conductive material, although other configurations are possible. This topology advantageously enables external circuitry to address each crosspoint 18 by its row and column address in a conventional manner. It is convenient for purposes of discussion only, to assume that conductors 12 are externally configured by electronic circuitry to serve as cathodes and conductors 16 to serve as anodes. The cathode material is advantageously chosen to be a conductive material generally impervious to sputtering, and is preferably zirconium. The anode material is also made of conductive material and is preferably nonoxidizable, such as nickel. Preferably, conductors 12 are approximately 1.2 microns tall and conductors 16 are eleven microns tall, both taken in a direction normal to surface 14*a*. Conductors 16 have a substantially thicker profile to impart dimensional stability for reasons which will become apparent in the discussion of the method of making the display 10. Conductors 12 and 16 preferably comprise stacked layers of conductive material to facilitate the manufacture and longevity of the display 10.

In accordance with the broad object of this invention, a gas may be contained at substantially atmospheric pressure yet may still be broken down into a plasma at or near its Paschen minimum firing voltage because the space 20 between conductors 12 and 16 is precisely dimensioned in the micron range. The plasma resulting from the gas breakdown emits a visible or ultraviolet discharge at a particular crosspoint 18 which, in conjunction with appropriate support circuitry and the other crosspoints 18, constitutes a video display. Display 10 may be backed by a cupping layer 22 mounted on surface 14*a* to seal out dust and other foreign particles. Because the contained gas is at substantially atmospheric pressure, there is an equilibrium of pressure inside and outside of the capped panel. To increase the brightness of the display and shift ultraviolet radiation into the visible spectrum, a screen 24 of phosphorescent material may be disposed on substrate 14 (FIG. 3).

The density of the picture elements achievable on display 10 is comparable to the line density of a High Definition Television (HDTV) display. The resolution of display 10 is directly related to the width of conductors 12 in the x-direction and the width of the conductors 16 in the y-direction. This is because wider conductors 12, 16 will decrease the overall number of crosspoints 18 per unit area. However, because current flow is proportional to the area of a crosspoint, a brighter image can be obtained by forming wider conductors. Thus, an engineer must strike a balance between resolution and brightness in accordance with application design criteria. For example, to achieve 1250 horizontal lines of resolution, as in an HDTV, a center-to-center conductor spacing of approximately 20 microns per inch of screen is required. This, of course, imposes an upper limit on the cross-sectional area and brightness of crosspoints 18. Therefore, although a 16×9 inch screen would require a 180 micron center-to-center spacing at this level of resolution, an engineer may elect to reduce the width of conductors 12 and 16 (while maintaining the requisite center-to-center spacing) to facilitate viewing of radiation from crosspoints 18 by exposing more of substrate 14 through which the radiation is seen. Thus, for example, conductors 12 and 16 may be advantageously formed 70 microns wide to leave 110 microns of exposed substrate through which radiation from crosspoints 18 may be viewed. This conductor width corresponds roughly to that of a single human hair and would be barely visible.

Referring now to the cross-sectional view in FIG. 3, a series of holes 26 are shown etched through conductors 12, to expose surface 14*a* of substrate 14. Preferably, holes 26 have a diameter D slightly smaller than the width W of conductors 12. Light discharged at each of the crosspoints 18 of display 10 can be viewed directly through the holes 26 which increases the overall brightness of the image by creating a linear path to view the discharge. The resulting "hollow" tube-like cathode structure affords several additional advantages. The hollow cathode structure is more efficient for sourcing electrons than a plate-like cathode because the walls of holes 26 accumulate a negative charge when a crosspoint 18 is initially fired so that subsequent firing of that cathode-anode pair may occur at a lower voltage; a result of the storage of wall potential which imparts a brief "memory" effect. Therefore, by employing a micro-hollow cathode as one electrode and a plate-like structure as the other, an asymmetry of firing voltage results as compared to adjoining pixels not recently fired. Additionally, the accumulated negative charge repels other electrons away from the walls of holes 26 which results in a denser, higher pressure plasma within the center of the hollow cathode which permits excitation of electrons at lower voltages.

The display 10 is operable using either direct or alternating current, however alternating current is a preferred mode of operation because it results in a brighter image. This is because a crosspoint 18 which has just previously been fired will briefly retain charge at the insulating layers of the electrodes of that crosspoint which combines with any subsequent applied voltage, like a memory cell, to sustain or trigger further discharge at a lower applied voltage. Light is emitted a larger portion of the scan time because a pixel can be fired each time the voltage reverses. Conductors 12 and. 16 have insulating layers 12*c*, 16*a* on their opposing surfaces to capacitively couple the conductors for a.c. operation. For d.c. operation, a simpler structure may be formed without insulating layers 12c, 16a encroaching on space 20.

As understood by those skilled in the art, the voltage applied to conductors 12 and 16 in the a.c. case is not quite the same as the voltage in space 20, the gas discharge region. The display panel structure for a.c. operation includes insulating layers 12*c*, 16*a* on either side of space 20 which can be modeled as thin capacitors (approx. 2000 angstroms) in series with a relatively thick capacitor which is space 20 (approx. 13 microns). Apart from differing dielectric constants, these thin insulating layers have significantly greater capacitance and hence a significantly smaller voltage drop across them. Accordingly, for an a.c. panel structure which includes insulating layers 12*c*, 16*a*, a voltage slightly greater than a Paschen minimum voltage may have to be applied to the conductors in order to initiate gas discharge at a crosspoint 18 of panel 10. For a d.c. panel structure which lacks these insulating layers, gas discharge can be initiated at or near the Paschen minimum voltage.

The method of making the flat screen display 10 of the present invention will now be described.

Figure 4:
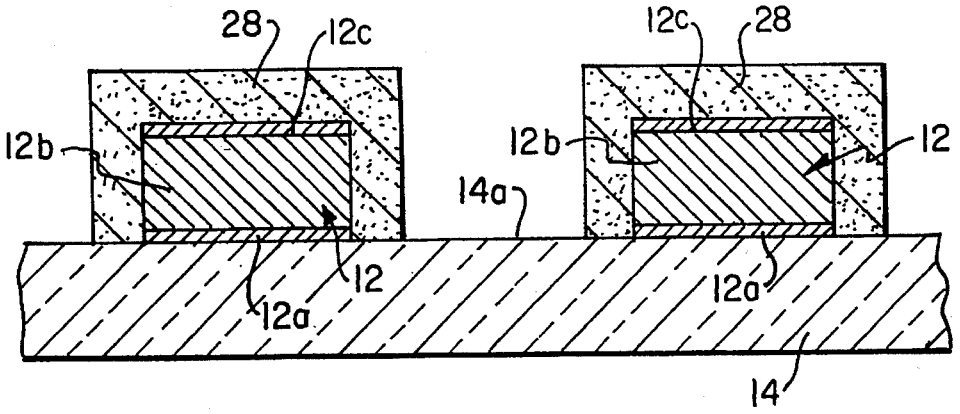
FIG. 4 is a cross-sectional view of a portion of a flat-panel display device being formed in accordance with a preferred embodiment of the present invention.

FIG. 4 shows, in cross-section, a first set of conductors 12 upon the surface 14*a* of substrate 14. Substrate 14 is preferably made of an insulating material and is transparent for viewing the video image therethrough. Substrate 14 is advantageously made of glass or high-temperature plastic. The first set of conductors 12 may be formed by depositing conductive material over substantially all of surface 14*a*, followed by the steps of masking and etching the material to form the conductors 12, as is conventional in the art of thin film manufacturing.

In a preferred embodiment, conductors 12 comprise several layers of material. A first layer 12*a* is deposited on surface 14*a* to ensure bonding to substrate 14. Preferably, this layer is a sheet of zirconium approximately 2500 angstroms thick. This layer is followed by the deposition of a second, nonoxidizing layer 12*b* that provides a solderable or electroformable base for further processing. Platinum is a suitable nonoxidizing material to be used as a second layer because it provides a base for soldering or electroforming additional layers, however, nickel is a preferred, less costly alternative which exhibits similar properties. This second layer 12*b* should be approximately one micron thick.

For a.c. operation, conductors 12 may be insulated from and capacitively coupled to an opposing second set of conductors 16, discussed below, which will be deposited so as to cross and overlie conductors 12, by depositing an insulating sheet as an uppermost layer 12*c* to the underlying conductive material. Preferably, a metal sheet such as zirconium is deposited as layer 12*c* and the zirconium is later oxidized, as discussed below, to form a 2000 angstrom thick insulating layer. For d.c. operation, layer 12*c* would be deposited in the same manner, however, it would not be oxidized but rather would remain a non-sputterable conductive material such as zirconium.

Once layers 12*a*, 12*b*, 12*c* have been deposited, they are masked and etched in conventional fashion to form a set of conductors 12, preferably parallel and linear, spaced apart from one another with surface 14*a* of substrate 14 exposed therebetween. If a hollow cathode structure is desired, the holes 26 may be formed in the same etch step done to form conductors 12, provided that a suitable mask is used. To protect the walls of holes 26 of the hollow cathodes from sputtering, they may be lined, by coating or a selective deposition step performed after the etch, with the material of layer 12*c*.

The etch may be a plasma or chemical etch process. As illustrated in FIG. 4, conductors 12 extend in the y-direction into the plane of the diagram. The width of conductors 12 in the x-direction (and the width of the conductors 16 in the y-direction in FIG. 5) bear a direct relation to the area of crosspoints 18. Because of the conflicting design criteria relating to brightness and resolution discussed above, an engineer must design a mask for etching conductors 12 (and 16) which strikes a balance in accordance with application criteria.

After the first set of conductors 12 are formed, a sacrificial spacer layer 28 is deposited so as to enwrap conductors 12. Layer 28 is selectively deposited or removed to form the structure shown in FIG. 4. The type of material used for spacer 28 is advantageously chosen to be a material etchable by means which minimally effect conductive layers 12 and 16, and is preferably copper.

Figure 5:
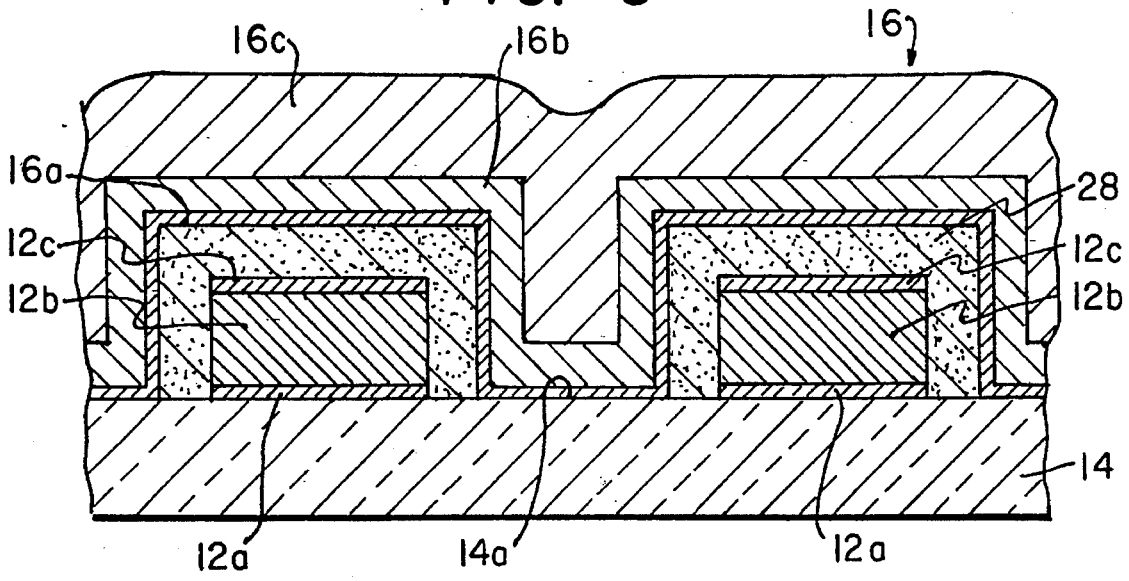
FIG. 5 is the structure of FIG. 4 at a later stage of processing.

Referring now to FIG. 5, a second set of conductors 16 is formed by first depositing conductive material over substantially all of surface 14*a* and the enwrapped conductors 12, and then etching the conductive material to form ribbons of conductors 16, by conventional plasma or chemical etch techniques.

Like conductors 12, conductors 16 preferably comprise several layers, the first and second layers may be identical to those of conductors 12. Thus, the first layer 16*a* is preferably a sheet of zirconium approximately 2500 angstroms thick deposited on surface 14*a* and spacer layer 28, to ensure bonding to substrate 14; the second layer 16*b* is preferably a one micron sheet of nickel to provide a solderable and electroformable base. A relatively thick (ten microns) layer 16*c* of nonoxidizable and solderable, and preferably electroformable, conductive material such as nickel or gold may be electroformed upon the base layer 16*b* in the form of conductive ribbons. Layer 16*c* has a thickness chosen to withstand subsequent etching steps. Prior to electroforming, a patterned and developed positive photosensitive resist layer would be applied to base layer 16*b* to define a pattern for the electroforming process; electroforming occurring only on the exposed areas. The resist and base layers 16*b* and perhaps some of bonding layer 16*a* are etched away in conventional manner, leaving behind a second set of conductors 16, spaced from one another with alternating regions of sacrificial layer 28 and surface 14*a* exposed therebetween (not shown).

The second set of conductors 16 must cross over conductors 12 to establish an array of crosspoints 18. The two sets 12 and 16 are separated by the height of sacrificial layer 28, as taken in a direction normal to surface 14*a*.

After conductors 16 are formed, sacrificial spacer layer 28 is selectively etched away in conventional manner by means which minimally effect conductive layers 12 and 16. Where layer 28 is chosen to be copper, a ferric nitrate chemical etch will selectively etch layer 28 from the enwrapper conductors 12. This selective etch forms an airbridge structure at each of the crosspoint regions 18 by removing layer 28 from between conductors 12 and 16 and exposes conductors 12 at all other locations. The result of this etch forms the structure of FIG. 2. The crosspoint regions 18 define an array of spaces or air gaps 20 between conductors 12 and 16, of a height equal to the thickness of sacrificial layer 28, as illustrated in FIG. 3. That portion of each of conductors 12 and 16 located at a given crosspoint 18 forms the electrode to which a voltage can be applied to induce light emissive gas discharge.

At this stage of processing, layers 12*c* and 16*a*, if metal, may be oxidized for a.c. operation to form symmetric and opposed insulating layers. The insulators protect crosspoints 18 from short circuiting and capacitively couple the electrodes. In the preferred embodiment and as seen in FIG. 3, the zirconium layers 12*c* and 16*a* are oxidized in an oxygen-bearing furnace for five to eight hours at 350° C. to form a zirconium oxide layer 2000 angstroms thick. The starting material for this oxide should be about 1000 angstroms thick; the net effect of the oxidation resulting in a negligible 2000 angstrom encroachment upon space 20. Of course, the high temperature oxidation step is omitted if the panel is to be used for d.c. operation.

In the preferred embodiment of FIG. 3, space 20 contains air at atmospheric pressure which undergoes light emissive discharge at the crosspoint 18 of conductors 12 and 16 when a suitable voltage is applied across space 20. Space 20 should be between ten and twenty-five microns in height and is preferably thirteen microns to ensure gas discharge at or near the Paschen minimum firing voltage at that pressure. At one atmosphere, 763 mm Hg, and a thirteen micron separation of electrodes, the pd product is 0.99 mm Hg cm which is substantially near $V_{min}$ for air. A slightly greater separation of electrode plates will increase the pd product and cause a rightward shift along curve A of FIG. 1. Nevertheless, the impact on the firing voltage in such a case would be gradual, and should not effect operation of the display because the firing voltage remains virtually constant, in the several hundred volt range. This affords the advantage of ease of interfacing the panel structure with conventional microelectronic circuitry.

The close spacing of the electrodes can result in pinhole shorts. This phenomenon results when a layer of metal such as conductors 16 is deposited over a thin film of insulating material such as spacer 28 and penetrates, through tiny holes in the thin film, and makes electrical contact with whatever underlies the thin film. When the underlying material is a conductor, as are conductors 12 in the present structure, the result is a direct short, known as a "pinhole" short. Methods are known for eliminating any pinhole shorts such as those disclosed in U.S. Pat. No. 3,461,524 to Lepselter, which patent disclosure is hereby incorporated by reference. The thirteen micron electrode spacing, which advantageously allows operation of display 10 at or near the paschen minimum firing voltage of air at atmospheric pressure, is sufficiently large so as to reduce the frequency of occurrences of pinhole shorts.

Close control over the size of space 20 is advantageously achieved by the single sided structure of the present invention in which a sacrificial layer 28 of controlled height is used to space conductors 12 and 16 at a predetermined tolerance. Of course, the foregoing is only a preferred manner of spacing two conductors, there being other known methods which one skilled in the field of microelectronics will recognize. To preselect the height of space 20, conductors 12 and 16 are advantageously chosen to be sufficiently rigid so that after the sacrificial spacer layer 28 is etched away, the resulting air bridge structure retains geometrical stability. The resulting space 20 between conductors 12 and 16 will, of course, act as a dielectric.

As an optional yet useful feature, a bonding tab 29 may be formed along at least one margin of conductors 12 and 16 for electrically connecting display 10 to external circuitry.

For higher brightness, a phosphorescent screen 24 may be deposited on the substrate below conductors 12. The phosphor screen 24 absorbs ultraviolet photons which illuminate screen 24 for a time period continuing after the radiation has stopped. Alternatively, a phosphorescent substance may be deposited on and between conductors 12 and 16 of an already formed display 10 by chemical vapor techniques. In this way, the upper set of conductors, conductors 16, serve as a partial mask to the deposition of the phosphor which results in discontinuities in the phosphor coating. These discontinuities are advantageous because they prevent radiated light from one pixel "bleeding" or "crawling" through the phosphor screen toward an adjacent pixel.

The entire structure except for the bonding tabs 29 may be capped by a capping layer 22 to seal out dust and other foreign particles. The capping layer 22 may be connected to substrate 14 by conventional means, as by fasteners, glue or heat treatment. In a preferred embodiment, air at atmospheric pressure is housed under the capping layer and in the spaces 20 at each crosspoint 18 of the crossed conductors 12 and 16. This establishes an equilibrium of pressure inside and outside of the capped panel. Unlike displays that are brought to a partial vacuum, there is no gas pressure exerted on the structure and no risk of implosion. This permits the manufacture of relatively large structures using low cost materials including plastic. Preferably, capping layer 22 is of a dark or black material to provide a contrasting background for viewing display 10 through transparent substrate 14. Capping layer 22 may include a metallic layer formed so as to reflect rearward directed light forward again, through substrate 14. The use of a metallic layer also facilitates the efficient release of any heat generated within the structure. Conversely, display 10 may be viewed through a suitably transparent capping layer 22 where the substrate 14 is opaque.

Figure 6:
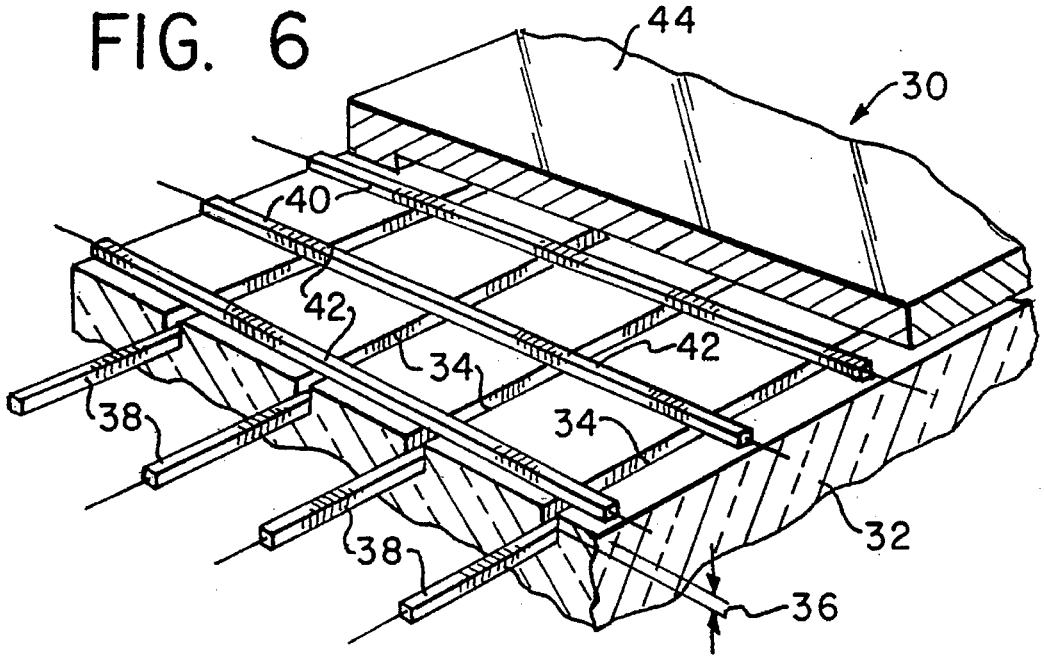
FIG. 6 is a perspective view of a portion of a flat-panel display device constructed in accordance with a second embodiment of the present invention.

In another embodiment of the present invention, illustrated in FIG. 6, a large flat-panel display 30 is formed on one side of a transparent panel 32. Panel 32 is preferably made of a rigid transparent material such as glass, glass fiber, or high-temperature plastic. Panel 32 has a set of rectangular slots 34 of predetermined depth 36 formed on one side. Slots 34 house a first set of wires 38 having a cross-section preferably chosen to conform to the shape of slots 34. Wires 38 are held taut by conventional means, preferably at their opposite ends. Across the top of slots 34 are a second set of wires 40, disposed at angles relative to the first set of wires 38 to form an array of crosspoints 42. Depth 36 is selected so that when wires 38 are disposed in slots 34 and wires 40 are stretched thereacross, the opposed surfaces of wires 38 and 40 are approximately thirteen microns apart so that a gas at atmospheric pressure may undergo light emissive discharge at or near its Paschen minimum voltage. Advantageously, wires 38 and 40 are coated with an insulating layer to capacitively couple the wires for a.c. operation. The display structure 30 may be capped by a capping layer 44 to keep out dust and other foreign particles. Because display 30 operates at atmospheric pressure, there are no implosive forces exerted on the structure. This permits the use of relatively inexpensive materials without mechanical braces without concern of implosion.

With the foregoing structure in mind, operation of the flat-panel display may now be described with reference to FIG. 7.

Figure 7:
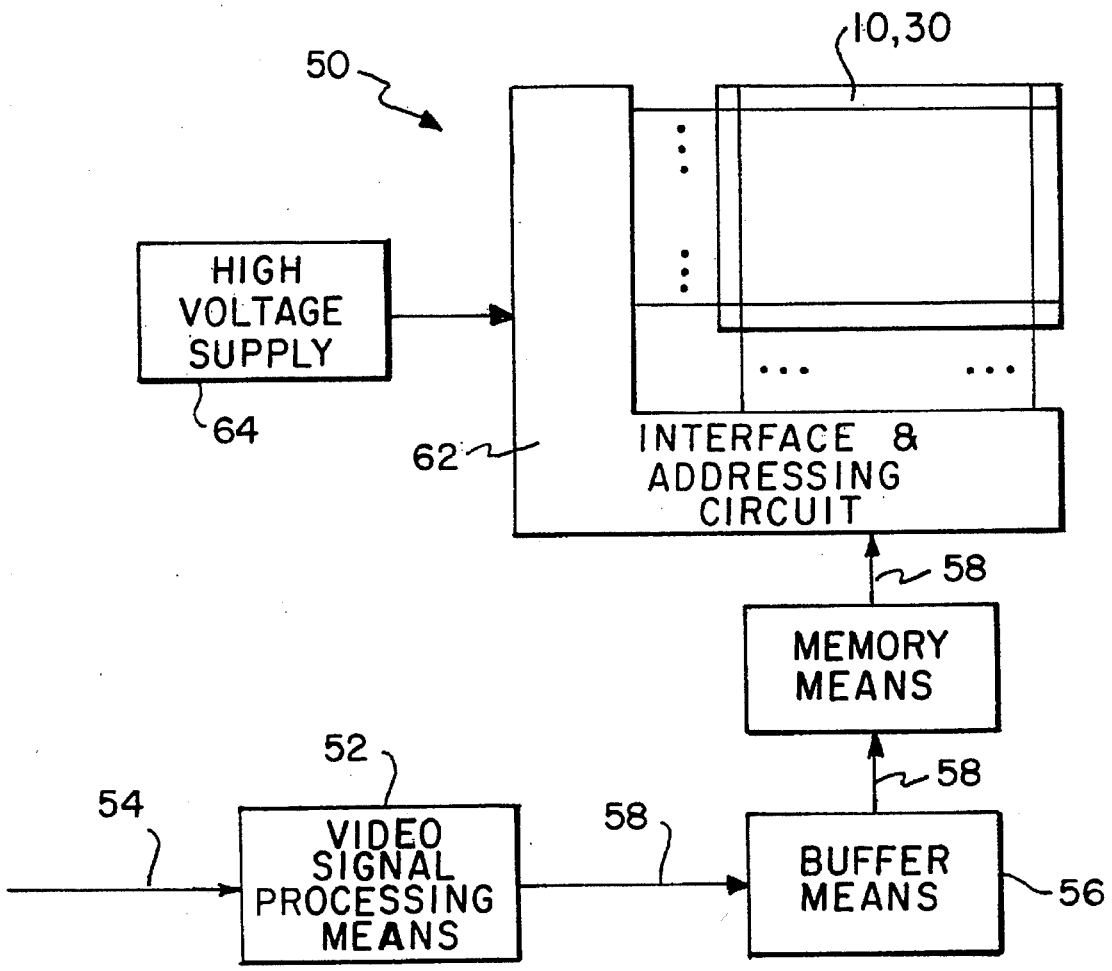
FIG. 7 is a block diagram of a video display system incorporating the flat-panel display of the present invention.

FIG. 7 illustrates a video display system 50 incorporating display 10, 30 of the present invention. A video signal that is to be displayed is preferably stored digitally, frame by frame in a digital memory chip. System 50 includes a video signal processing means 52 which receives analogue or digital video signals 54 and provides signals 54, in digital format, to buffer means 56 as digitalized signals 580 Buffer means 56 is a temporary storage area that stores at least one video frame of digitalized signals 58. Buffer means 56 preferably comprises a conventional random access memory (RAM) chip or variety thereof (SRAM, DRAM, etc.). Each video frame is preferably converted into a digitalized array of pixels, advantageously addressable by row and column coordinates corresponding to like coordinates of the original video signal. Video signal processing means 52 converts signals 54 into an addressable array of pixels and assigns intensity information to each pixel address. Buffer means 56 stores the addressable digitalized signals 58, in conventional manner, by row and column coordinates. Digitalized signals 58 may comprise status, intensity, and color level information.

A memory means 60 may receive one video frame of digitalized signals 58 from buffer means 56 so that the next video frame 58' may be loaded into buffer means 56. Memory means 60 may also be a conventional RAM chip.

For grey-scale black and white operation, along with the information indicating whether a pixel is "on" or "off", there is associated with each pixel address least information relating to the brightness of the pixel. This information may be stored in the form of one or more bytes of digital memory of buffer means 56 (and memory means 60). Each byte of memory used can store 64 different brightness levels for a given pixel.

In operation, the pixels of display 10, 30 are addressed or scanned sequentially, a row at a time, by interface and addressing circuit 62 ("IAC"). IAC 62 receives digitalized signals 58 from memory means 60 and high voltage from high voltage supply 64 and selectively applies a high voltage signal at crosspoints 18, 42 in accordance with the status and intensity information associated with each pixel of a given video frame 58. Of course, memory means 60 may be internal to IAC 62, along with buffer means 56 and video signal processing means 52 depending on the level of integration of circuitry, e.g. very large scale or ultra-large scale integration. IAC 62 scans display 10, 30 at least 60 times per second so that a human eye may perceive a steady video image corresponding to video signal 54.

If a given pixel is in the "off" state, as indicated by the status information received by IAC 62 from memory means 60, then high voltage supply 64 will not be applied to the crosspoint 18, 42 presently being scanned and no light will radiate from that location on the panel. However, if the pixel is in the "on" state, also as indicated by the status information received from IAC 62, then high voltage supply 64 will be applied to the crosspoint 18, 42 presently being scanned which will induce gas discharge and illuminate that crosspoint of the display for the present scan cycle.

To perceive a grey scale, that is, shades of intensities on display 10, 30, IAC 62 scans display 10, 30 at a multiple of the requisite 60 times per second, preferably in the megahertz range. The stored intensity information for each pixel may be decremented or modified each time display 10, 30 is scanned until the intensity information corresponds to a preselected value at which time high voltage supply 64 will no longer be applied upon subsequent scanning of the same video frame 58. Thus, assuming display 10, 30 is scanned thirty two times over the course of one sixtieth of a second, one pixel having an intensity of "eight" may be on one fourth of one sixtieth of a second whereas another pixel having an intensity of "sixteen" may be on for one half the scan time. Because the eye is not sensitive to such rapid flashes, the result is a range of brightness limited only by the range of stored brightness levels and processor speed. Because display 10, 30 is operated at relatively high pressure, the electrons in the plasma have relatively short diffusion lengths and recombine with ions to extinguish the discharge rapidly. This advantageously enables fast processing and a wider grey or "Z" scale of operation.

It should be realized that display 10 may be viewed from the front or the rear, either through substrate 14, when substrate 14 is transparant, or through capping layer 22. Additionally, display 10 may be viewed through both sides, but not at the same time, by including means for swapping the column addresses, left to right, of the digitalized signal so that the image on the reverse side of the panel appears in the same spacial location as the original video signal.

One skilled in the art will recognize that conductors 12 and 16 need not be linear strips of conductive material as shown, but may be crossed sinusoids, square or triangular wave patterns or the like, limited only by the requirement that an array of crosspoints 18 be formed for viewing the video signal.

From the foregoing description, it will be clear that the present invention may be embodied in other specific forms without departing from the spirit or essential characteristics thereof. Thus, for example, while the examples discussed above have described a directly viewable display panel, the panel could likewise project an image onto a half-silvered mirror to form a "head up" display. Likewise, while grey-scale operation has been described, color operation is obtainable through conventional use of multiple crosspoints 18 per pixel in conjunction with color filters or color phosphors. The presently disclosed embodiments are therefore to be considered in all respects as illustrative and not restrictive, the scope of the invention being indicated by the appended claims, and not limited to the foregoing description.

I claim:

1. A flat-panel plasma display structure, comprising:

a substrate;

a first set of conductors on said substrate;

a second set of conductors on said substrate and disposed at an angle to said first set of conductors and at a preselected distance therefrom, said second set of conductors crossing over said first set of conductors, said preselected distance determined by the selective removal of a sacrificial layer formed between said first and second sets of conductors to thereby define a discharge space between said conductors at the crosspoints;

a gas in said discharge space, the gas being at substantially atmospheric pressure; and a capping means on said substrate for covering at least a portion of said first and second sets of conductors and for sealing said gas.

2. The flat-panel plasma display structure as in claim 1, wherein said gas is air.

3. The flat-panel plasma display structure as in claim 1, wherein any light emissive discharge in said discharge space is ultraviolet light.

4. The flat-panel plasma display structure as in claim 1, further comprising a phosphor coating deposited on and between said first and second sets of conductors.

5. The flat-panel plasma display structure as in claim 1, wherein one of said first and second sets of conductors is made of a non-sputterable material.

6. The flat-panel plasma display structure as in claim 1, wherein at least one of said first and second sets of conductors includes an aperture at each of said crosspoints whereby any light emissive discharge in said discharge space may be observed therethrough.

7. The flat-panel plasma display structure as in claim 6, wherein the at least one of said first and second sets of conductors having an aperture at each of said crosspoints is made of a non-sputterable material.

8. The flat-panel plasma display structure as in claim 1, further comprising a phosphor coating disposed on said substrate.

* * * * *

UNITED STATES PATENT AND TRADEMARK OFFICE

CERTIFICATE OF CORRECTION

PATENT NO. : 5,469,021

DATED : November 21, 1995

INVENTOR(S) : Martin P. Lepselter

It is certified that error appears in the above-indentified patent and that said Letters Patent is hereby corrected as shown below:

Column 1, line 9 reads "foraged" and should read --formed--.

Column 6, line 29: reads "enwrapper" and should read --enwrapped--.

Signed and Sealed this

Twenty-sixth Day of March, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,469,021

DATED : November 21, 1995

INVENTOR(S) : Martin P. Lepselter

It is certified that error appears in the above-indentified patent and that said Letters Patent is hereby corrected as shown below:

On the title page, item [73] Assignee, please change;

"BTL Fellows Company LLC; Spectron Corporation of America, L.L.C., both of Summit, NJ" to --Spectron Corporation of America, L.L.C. of Summit, NJ--.

Signed and Sealed this

Seventh Day of May, 1996

Bruce Lehman

*Attest:*

BRUCE LEHMAN

*Attesting Officer*

*Commissioner of Patents and Trademarks*